United States Patent [19]

Kubo

[11] Patent Number: 4,766,016

[45] Date of Patent: Aug. 23, 1988

[54] METHOD OF APPARATUS OF APPLYING A LIQUID TO A PLANE SURFACE

[76] Inventor: Chikanari Kubo, 7-2-101, Shin-Isono 4-chome, Sagamihara City, Kanagawa Pref., Japan

[21] Appl. No.: 112,057

[22] Filed: Oct. 22, 1987

Related U.S. Application Data

[63] Continuation of Ser. No. 871,795, Jun. 9, 1986, abandoned.

[51] Int. Cl.[4] ..... B05D 1/28

[52] U.S. Cl. ..... 427/428; 118/207; 118/260; 118/259

[58] Field of Search ..... 118/207, 260, 259; 427/428

[56] References Cited

U.S. PATENT DOCUMENTS

| | | | |
|---|---|---|---|
| 950,277 | 2/1910 | Current et al. | 118/260 X |
| 2,366,198 | 1/1945 | Kresse et al. | 118/260 X |
| 2,510,390 | 6/1950 | Dulken et al. | 118/260 |
| 2,660,791 | 12/1953 | Howell et al. | 118/207 X |
| 3,468,286 | 9/1969 | Nugarus | 118/259 |
| 4,079,694 | 3/1978 | Galinou | 118/207 |
| 4,359,963 | 11/1982 | Saito et al. | 118/260 |
| 4,471,713 | 9/1984 | Cote et al. | 118/207 |

*Primary Examiner*—Shrive P. Beck

*Attorney, Agent, or Firm*—Andrus, Sceales, Starke & Sawall

[57] ABSTRACT

The present invention a method of applying a liquid to a plane surface in very thin and uniform layer, the method including the steps of supplying a liquid at a predetermined rate to a liquid impregnating member through a variable displacement pump the displacement of which can optionally be controlled, maintaining the liquid impregnating member at its saturated state and contacting the liquid impregnating member in the saturated state with a roller with a predetermined pressure under the action of a spring.

The present invention also provides an apparatus of applying a liquid to a plane surface in very thin and uniform layer, the apparatus comprising a variable displacement pump the displacement of which can optionally be controlled exactly, a roller for uniformly applying liquid to a plane surface, a liquid impregnating member receiving the liquid at a predetermined rate from the variable displacement pump and maintained at its saturated state and a spring for contacting the liquid impregnating member with the roller with a predetermined pressure, whereby the liquid can uniformly be transferred from the liquid impregnating member to the roller means and then the liquid can uniformly be applied from the roller to the plane surface.

2 Claims, 3 Drawing Sheets

METHOD OF APPARATUS OF APPLYING A LIQUID TO A PLANE SURFACE

This application is a continuation of copending application Ser. No. 871,795 filed June 9, 1986, now abandoned.

BACKGROUND OF THE INVENTION

1. Field of the Invention

The present invention relates to a method and apparatus of applying a liquid such as oil, ax, paint or the like to a plane surface as in bowling lanes, floors, plate-like members and others. Particularly, the present invention relates to such a method and apparatus suitable for applying the liquid as a very thin layer to such a plane surface.

2. Description of the Prior Art

For example, alley bed surfaces of bowling lanes have to be subjected to frequent cleaning and maintenance such that bowling balls can be rolled on the bowling lanes under a good condition and also the bowling lanes can equally be conditioned competitions. The maintenance of the bowling lanes is accomplished by polishing their alley beds after oil has been applied thereto uniformly into a very thin layer.

One of methods for applying a liquid such as oil to the plane surfaces of the bowling lanes is that a spraying nozzle is used to spray the liquid into the plane surfaces. However, it is very difficult to apply the very thin layer of the liquid uniformly to the plane surfaces since the nozzle may frequently be clogged and since when a plurality of nozzles are utilized, there may be interference and difference in function between the nozzles.

Another method of applying the liquid to the plane surfaces is the use of rotary roller drums each of which is partially submerged in a bath of liquid to be applied. A transfer roller drum is operably connected between each of the submerged roller drums and an applicator roller drum which contacts the corresponding plane surface, in a rolling contact manner. The liquid will be applied from the submerged roller drum to the plane surface through the transfer roller drum. In such a method, however, it is also very difficult to apply the liquid to the plane surfaces uniformly and steadily since the amount of the liquid applied is remarkably variable from one plane surface to another due to various factors such as drum revolutions, spacing between the drums, viscosity of the liquid used, pressures against the plane surfaces and others.

U.S. Pat. No. 3,604,037 discloses a liquid applicator in which liquid is once impregnated and saturated in felt means and the felt means is then contacted by cylindrical applicator rollers such that the liquid will be transferred from the felt means to the applicator rollers. However, such a liquid applicator also has the same problems as in the second mentioned method since the cylindrical applicator rollers are contacted by the plane surfaces to apply the liquid thereto, resulting in the variable amount of the liquid applied due to various factors the spacing between the rollers, the viscosity of the liquid, the pressures and others.

SUMMARY OF THE INVENTION

It is therefore an object of the present invention to overcome the above problems and to provide a method and apparatus which can continuously apply a liquid to plane surfaces in very thin layers and can exactly control the amount of liquid to be applied.

To this end, the present invention provides a method of applying a liquid to plane surfaces in very thin and uniform layers, the method comprising the steps of supplying a liquid to liquid impregnating means at a predetermined rate by means of a variable displacement pump in which its displacement can optionally be controlled saturating the liquid impregnating means with the liquid and maintaining the liquid impregnating means at its saturated state, bringing the saturated impregnating means into contact with roller means under a fixed pressure by spring means to transfer the liquid uniformly from the liquid impregnating means to said roller means and finally applying the liquid uniformly from said roller means to the plane surfaces.

Further, the present invention provides an apparatus of applying a liquid to plane surfaces in very thin and uniform layers, the apparatus comprising a variable displacement pump having its displacement which can optionally be controlled, roller means for uniformly applying the liquid to plane surfaces, liquid impregnating means saturated by the liquid supplied by said variable displacement pump at a predetermined rate and maintained at the saturated state and spring means for contacting the liquid impregnating means with said roller means under a fixed pressure, whereby the liquid can uniformly be transferred from said liquid impregnating means to said roller means and uniformly applied from said roller means to the plane surfaces.

DESCRIPTION OF PREFERRED EMBODIMENT

Figure 2:
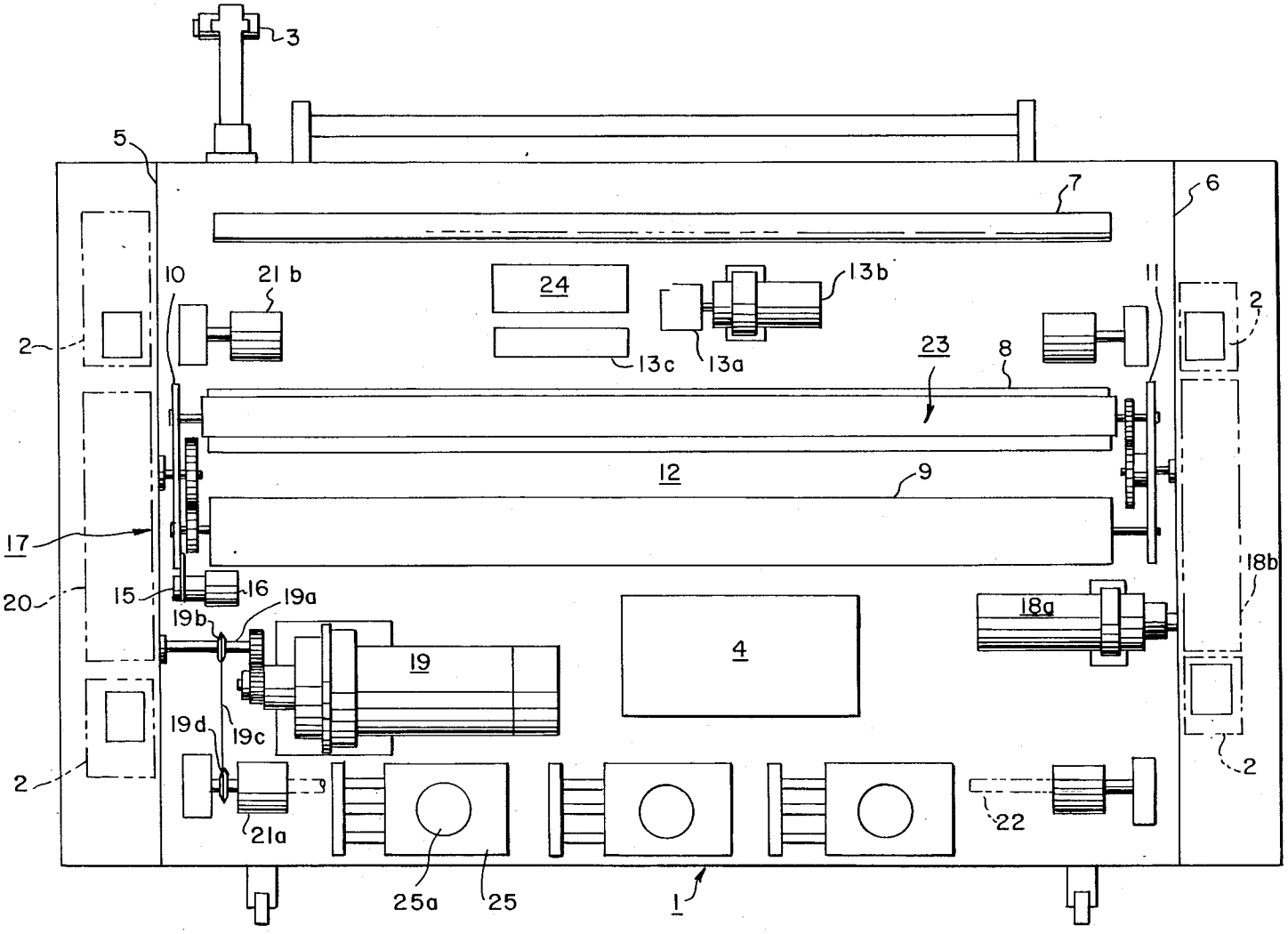
FIG. 2 is a plan view of the liquid applicator shown in FIGS. 1A and 1B.

Referring now to FIG. 2, there is shown a bowling lane conditioning system in which the principle of the present invention is embodied. The bowling lane conditioning system comprises a body 1 which is adapted to move on a bowling lane along the length thereof to clean it and then to apply oil to the bowling lane for conditioning and maintenance. Thereafter, the body is automatically moved sideways to the adjacent bowling lane by means of traversing mechanism 2 and then along the adjacent bowling lane to clean it and to apply the oil thereto. This automatic sequence is controlled by a controller 4 which receives various output signals from a distance integrating mechanism (not shown) for counting the travel of the conditioning system body 1, the traverse sensor 3 and others.

The body 1 comprises a pair of longitudinally extending side plates 5 and 6 spaced parallel from each other. Between the side plates 5 and 6 are arranged a cleaning unit 7, an oil applying roller 8 and a buff roller 9 all of which extend perpendicular to the side plates 5 and 6. The oil applying roller 8 and buff roller 9 are spaced parallel from each other and rotatably supported between side plates 10 and 11 which extend parallel to the respective side plates 5 and 6 and are respectively rotatably supported by the respective side plates 5 and 6. The side plates 10, 11 and rollers 8, 9 thus constitute a roller unit 12.

As will be apparent hereinafter, such a roller unit 12 can selectively be held at one of oil applying, neutral and buffing positions by means of the controller 4 and a swinging mechanism 17 which comprises a compressor 13*a*, a compressore drive motor 13b, a source of compressed air 13*c* and air cylinders 15 and 16.

The oil applying roller 8 is rotatingly driven by a drive motor 18a through a power transmission mechanism 18*b* which is located outside of the side plate 6. On the other hand, the buff roller 9 is rotatingly driven by a drive motor 19 through a power transmission mechanism 20 disposed outside of the side plate 5. The output shaft 19*a* of the drive motor 19 also is drivingly connected with the axle 22 of drive wheels 21*a* on the body 1 through a drive train including a sprocket 19*b*, a chain 19*c* and a sprocket 19*d*. Thus, the body 1 supported by the drive wheels 21*a* and driven wheels 21*b* can be moved forwardly or rearwardly on a bowling lane along the length thereof.

On the oil applying roller 8 is disposed an oil supply unit 23 for supplying oil to the oil applying roller 8. The oil supply unit 23 receives the oil at a predetermined rate from a source of oil 24 through three variable displacement pumps 25. Each of the variable displacement pumps 25 is driven by a pulse motor 25*a* which is optionally controlled by variable pulse signals to adjust the displacement of the pump 25.

Figure 1A:
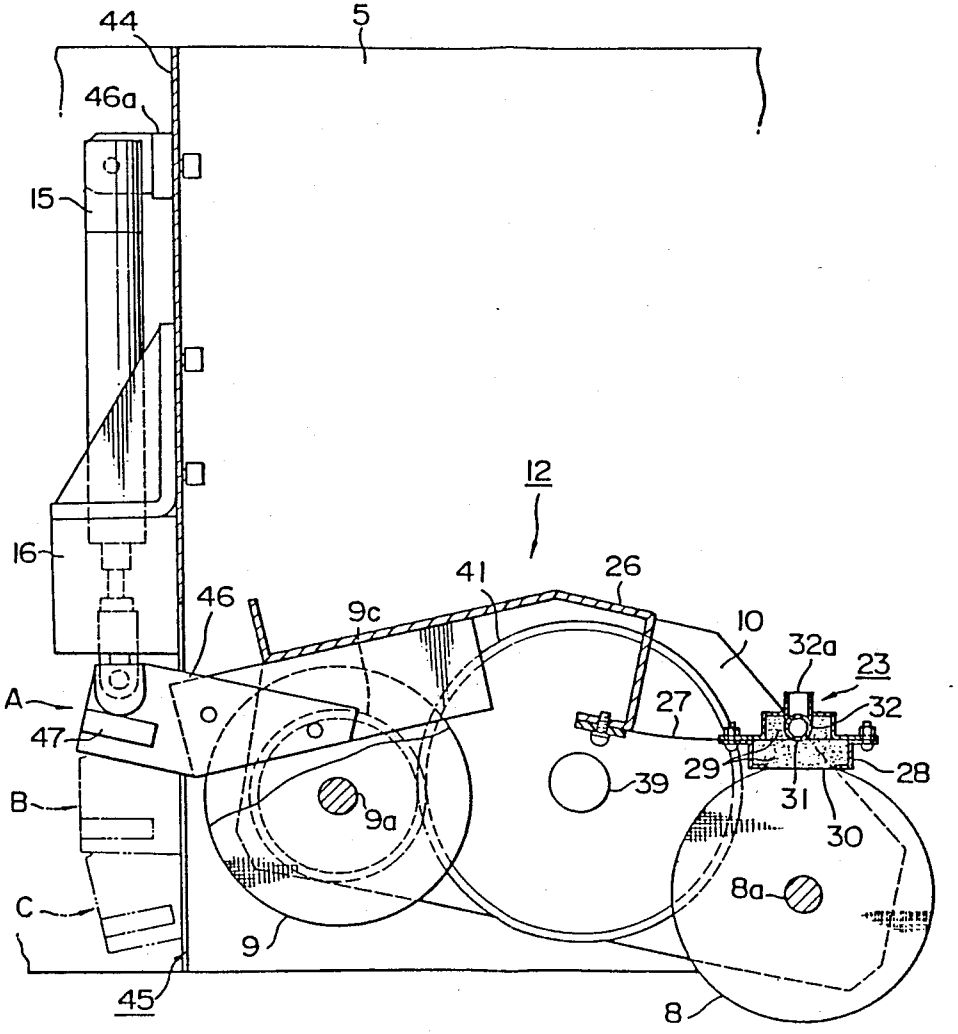
FIG. 1A is a longitudinal section of a liquid applicator constructed in accordance with the present invention, taken along a line I—I in FIG. 3.
Figure 1B:
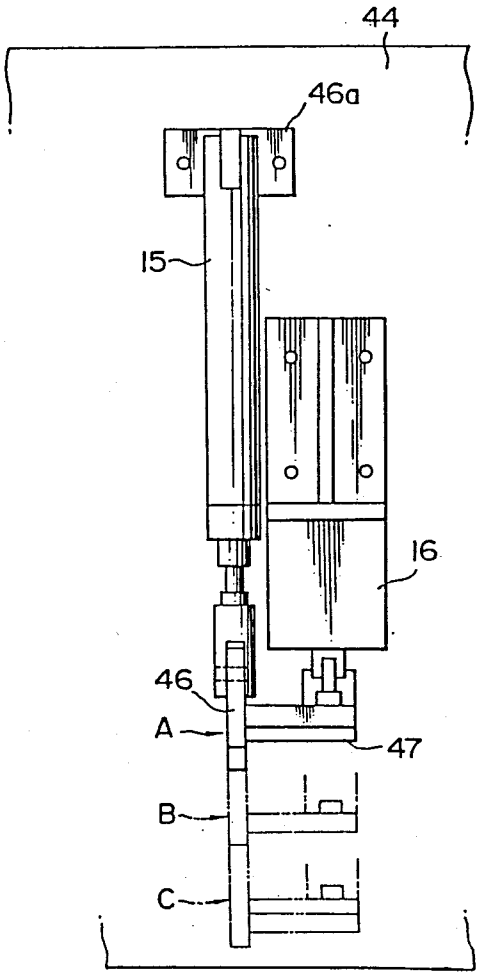
FIG. 1B is a side elevational view of the liquid applicator shown in FIG. 1A.
Figure 3:
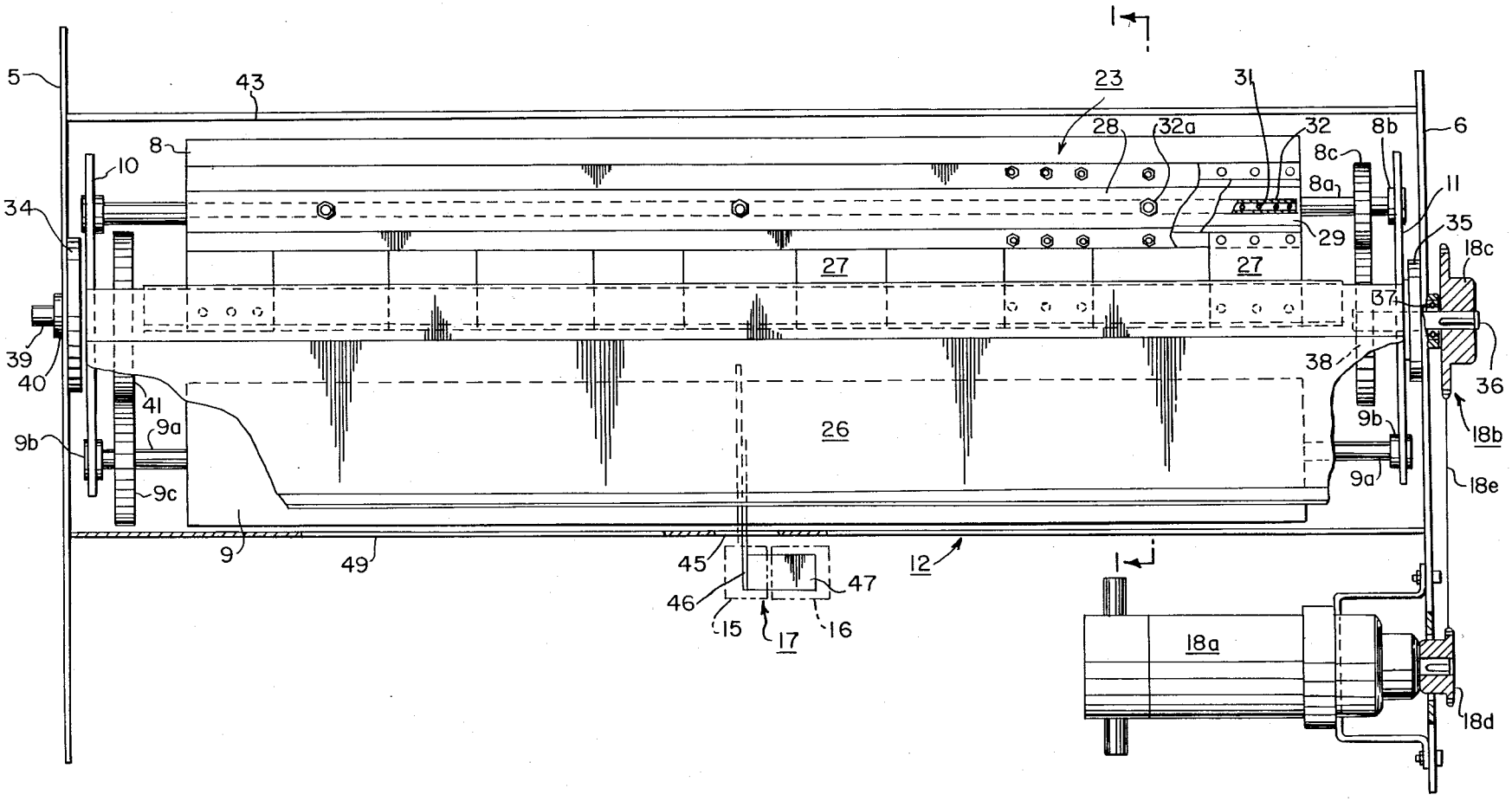
FIG. 3 is a fragmentary enlarged view of part of the liquid applicator shown in FIG. 2, partialy broken away and in section.

Referring particularly to FIGS. 1 and 3, the oil supply unit 23 is rigidly mounted on one end of a spring assembly including six leaf springs 27 with the other end thereof connected with an upper plate 26 which in turn is connected between the side plates 10 and 11. The oil supply unit 23 extends parallel to the oil applying roller 8 and has its bottom resiliently engaging the top of the oil applying roller 8 under the action of the leaf spring assembly 27. The oil supply unit 23 is filled with a felt 29 impregnated with the oil. The bottom face of the felt 29 is in contact with the oil applying roller 8 along the length thereof and through an opening 30 in the bottom of a cover 28 under a fixed pressure. The felt 29 includes a pipe 32 located therein and extending along the length of the oil supply unit 23, the pipe 32 being formed with a plurality of oil supply ports 31 spaced longitudinally from one another. The pipe 32 also includes three inlets 32*a* extending upwardly from the oil supply unit 23 each of which receives the oil at a predetermined rate per hour from the source of oil 24 through the respective pump 25. The amount of oil to be supplied can optionally be established by the controller 4 which controls electric pulses to the pulse motor 25*a* in each of the variable displacement pumps 25.

The rotating shafts 8*a* and 9*a* of the oil applying and buff rollers 8 and 9 are rotatably supported in bearings 8*b* and 9*b* on the side plates 10 and 11, respectively. Thus, the relative position between the connection of the leaf spring assembly 27 with the upper plate 26 and the rotating shaft 8*a* of the oil applying roller 8 is invariable so that the contact pressure between the felt 29 of the oil supply unit and the oil applying roller 8 will be maintained constant.

The roller unit 12 including the side plates 10, 11 and the upper plate 26 is rotatably supported by bearings 34 and 35 at the side plates 5 and 6. A shaft 36 extends through the bearing 35 and supported by a bearing 37 on the side plate 6. The shaft 36 includes a gear wheel 38 rigidly mounted on the inner end thereof and which operably engages a gear wheel 8*c* on the rotating shaft 8*a*. The other or outer end of the shaft 36 rigidly supports a sprocket 18*c* which is drivingly connected with a sprocket 18*d* on the output shaft of a drive motor 18*a* through a chain 18*e* to form a power transmission mechanism 18*b*.

A shaft 39 extends through the bearing 34 and is rotatably supported by a bearing 40 on the side plate 5. The shaft 39 has its inner end rigidly supporting a gear wheel 41 which drivingly engages a gear wheel 9*c* on the rotating shaft 9*a*. The other end of the shaft 39 is connected with the power transmission mechanism 20.

The roller unit 12 is disposed within a space bounded by the side plates 5, 6 and two vertical partition plates 43, 44. The roller unit 12 comprises an arm member 46 which is rigidly secured at one end to the upper plate 26 of the unit and extends through a notch 46 in the partition plate 44 to the side opposite to the roller unit 12. The arm member 46 is actuated by the two air cylinders 15 and 16 in the swinging mechanism 17. As be best seen from FIG. 1, the body of the first air cylinder 15 is pivotally mounted on one end on the partition plate 44 through a hinge 46*a*. The outer or lower end of a piston rod slidably mounted in the first air cylinder 15 is pivotally connected with the end of the arm member 46. The arm member 46 also includes a projection 47 extending parallel to the partition plate 44. The projection 47 is engaged at its top by the piston end of the positioning air cylinder 16 which is similarly rigidly mounted on the partition plate 44. These air cylinders 15 and 16 are connected with the source of compressed air 13*c* and actuated by the compressed air from the source 13*c* under the control of the controller 4 such that the arm member 46 and thus the roller unit 12 will selectively be positioned at one of various positions, that is, an oil applying position A, a neutral position B and a buffing position C.

On operation, the bowling lane conditioning body 1 is first placed on a bowling lane at one end. The controller 4 is then set with respective to the dimensions of an area between the foul line and the pin zone to which a predetermined amount of oil is to be applied, the number of bowling lanes and so on. The body 1 is then initiated to move forwardly to clean the surface of the bowling lane by the cleaning unit 7 before the oil is applied to said area. On the application of oil, the air cylinders 15 and 16 are actuated to set the roller unit 12 at the oil applying position A wherein the oil applying roller 8 engages the surface of the bowling lane. The oil supply unit 23 receives the oil at a predetermined rate per hour from the variable displacement pumps 25 through the inlets 32a in the pipe 32 via a piping (not shown). The supplied oil is then applied to the felt 29 through the supply ports 31 in the pipe 32. The felt 29 in the case 28 is saturated with the oil and maintained at the saturated state. Thus, the oil is transferred to the oil applying roller 8 which is rotatingly driven through the power transmission mechanism 18*b* in contact with the bottom of the felt 29. Since the oil supply unit 23 is engaged by the oil applying roller 8 with a fixed contact pressure under the influence of the leaf spring assembly 27 even in the oil applying position A, the transfer of the oil from the felt to the roller is uniform along the length of the oil applying roller 8. The amount of the oil transferred from the felt to the oil applying roller 8 is equal to the displacement of the pumps 25 since the felt 29 in the cover 28 is in its saturated state. Thus, by suitably selecting electric input pulses to the pulse motors 25*a*, the transfer of the oil from the felt to the roller can optionally be controlled. In addition, the change of the displacement in the pumps 25 is instantaneously converted into the change of the transfer of oil from the felt to the roller. Since the oil applying roller 8 has a slight absorption, the transferred oil is fully applied to the bowling lane.

When the body 1 is move past the area to be applied, the swinging mechanism 17 is actuated to shift the roller unit 12 to the buffing position C. The buff roller 9 is then rotated while moving the body 1 rearwardly to buff the surface of the bowling lane. On operations other than the oil applying and buffing operations, the roller unit 12 is held at the neutral position B wherein no rollers are in contact with the bowling lane.

As be apparent from the foregoing, the design of the present invention is such that roller means for uniformly applying a liquid to a plane surface is in contact with liquid saturated means with a fixed pressure under the action of spring means and such that the liquid saturated means is adapted to receive the liquid at a predetermined rate from pump means. Accordingly, the liquid can uniformly be transferred from the liquid saturated means to the roller means throughout the longitudinal ratio thereof and also the liquid can continuously and uniformly be applied to the plane surface in very thin layer. Furthermore, the displacement of the pump means can be varied to positively control the amount of the liquid applied to the plane surface. If a plurality of such oil applying units are used, thus, the amount of liquid to be applied can equally be set through these units.

Although the present invention has been described mainly as to an apparatus of applying oil to bowling lanes, it is to be understood that the present invention can be embodied in the other forms, such as an apparatus of applying wax to floors in buildings or an apparatus of continuously applying very thin layers of a liquid to the surfaces of plate-line members being conveyed by belt conveyor means.

I claim:

1. A method of applying a thin and uniform layer of a liquid to a plane surface, comprising the steps of:

(a) providing:

(1) a rotatable liquid applicator roller adapted to engage and apply liquid to a said plane surface, (2) a liquid supply unit having a liquid impregnatable element therein, (3) and a selectively controllable variable displacement pump, said pump having an output providing a flow of liquid at a predetermined variable rate, (b) baising said liquid supply unit toward said roller so that said liquid impregnatable element is maintained in continuous engagement with said roller at a constant contact pressure, (c) pumping liquid from said pump output directly to said liquid impregnatable element so that the rate of flow of liquid to said element is directly responsive to said predetermined liquid flow rate at said pump output and maintains said element in a saturated state;

(d) and controlling the displacement of said pump so that the amount of liquid transferred from said element to said applicator roller is equal to the rate of flow of liquid from said pump to said element.

2. An apparatus for applying a thin, uniform layer of a liquid to a plane surface, comprising, in combination:

(a) a rotatable liquid applicator roller (8) adapted to engage and apply liquid to a said plane surface, (b) a liquid supply unit (28) generally axially coextensive with and disposed adjacent said roller, (c) a liquid impregnatable element (29) disposed in said supply unit, (d) spring means (27) biasing said liquid supply unit toward said roller in a manner so that said liquid impregnatable element is maintained in continuous engagement with said roller at a constant contact pressure, (e) a selectively controllable variable displacement pump (25) associated with said liquid supply unit, said pump having an output providing a flow of liquid at a predetermined variable rate, (f) conduit means providing a direct liquid flow connection between said pump output and said liquid impregnatable element in a manner so that the rate of flow of liquid to said element is directly responsive to said predetermined variable liquid flow rate at said pump output and maintains said element in a saturated state;

(g) and control means for controlling the displacement of said pump so that the amount of liquid transferred from said element to said applicator roller is equal to the rate of flow of liquid from said pump to said element.

* * * * *